US010134383B2

(12) United States Patent
Stern et al.

(10) Patent No.: US 10,134,383 B2
(45) Date of Patent: *Nov. 20, 2018

(54) SYSTEM AND METHOD FOR DISTRIBUTED VOICE MODELS ACROSS CLOUD AND DEVICE FOR EMBEDDED TEXT-TO-SPEECH

(71) Applicant: AT&T Intellectual Property I, L.P., Atlanta, GA (US)

(72) Inventors: Benjamin J. Stern, Morris Township, NJ (US); Mark Charles Beutnagel, Mendham, NJ (US); Alistair D. Conkie, Morristown, NJ (US); Horst J. Schroeter, New Providence, NJ (US); Amanda Joy Stent, Chatham, NJ (US)

(73) Assignee: AT&T INTELLECTUAL PROPERTY I, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/699,616

(22) Filed: Sep. 8, 2017

(65) Prior Publication Data

US 2017/0372692 A1 Dec. 28, 2017

Related U.S. Application Data

(63) Continuation of application No. 14/953,771, filed on Nov. 30, 2015, now Pat. No. 9,761,218, which is a continuation of application No. 14/025,344, filed on Sep. 12, 2013, now Pat. No. 9,218,804.

(51) Int. Cl.

| | |
|---|---|
| ***G10L 13/04*** | (2013.01) |
| ***G10L 13/07*** | (2013.01) |
| ***G10L 13/047*** | (2013.01) |

(52) U.S. Cl.
CPC ..... *G10L 13/04* (2013.01); *G10L 13/047* (2013.01); *G10L 13/07* (2013.01)

(58) Field of Classification Search
CPC ..... G10L 13/04
USPC ..... 704/260
See application file for complete search history.

(56) References Cited

U.S. PATENT DOCUMENTS

| | | | | |
|---|---|---|---|---|
| 6,604,077 | B2 | 8/2003 | Dragosh et al. | |
| 6,625,576 | B2 * | 9/2003 | Kochanski ..... | G10L 13/047 704/258 |
| 7,483,834 | B2 | 1/2009 | Naimpally et al. | |
| 8,321,223 | B2 | 11/2012 | Meng et al. | |

(Continued)

FOREIGN PATENT DOCUMENTS

| | | |
|---|---|---|
| WO | WO 2012148112 | 1/2012 |

OTHER PUBLICATIONS

Hoory et al., "Embedded Concatenative Text-to-Speech," IBM Labs in Haifa, Oct. 14, 2004, pp. 1-20.

(Continued)

*Primary Examiner* — Susan McFadden

(57) ABSTRACT

Systems, methods, and computer-readable storage media for intelligent caching of concatenative speech units for use in speech synthesis. A system configured to practice the method can identify, in a local cache of text-to-speech units for a text-to-speech voice an absent text-to-speech unit which is not in the local cache. The system can request from a server the absent text-to-speech unit. The system can then synthesize speech using the text-to-speech units and a received text-to-speech unit from the server.

20 Claims, 4 Drawing Sheets

(56) References Cited

U.S. PATENT DOCUMENTS

| | | | | |
|---|---|---|---|---|
| 8,380,508 | B2 | 2/2013 | Plumpe | |
| 9,218,804 | B2 * | 12/2015 | Stern | G10L 13/07 |
| 9,761,218 | B2 * | 9/2017 | Stern | G10L 13/04 |
| 2002/0168089 | A1 | 11/2002 | Guenther et al. | |
| 2003/0028380 | A1 | 2/2003 | Freeland et al. | |
| 2003/0078775 | A1 | 4/2003 | Plude et al. | |
| 2005/0215260 | A1 | 9/2005 | Ahya et al. | |
| 2005/0256716 | A1 | 11/2005 | Bangalore et al. | |
| 2006/0200355 | A1 | 9/2006 | Sideman | |
| 2010/0274838 | A1 | 10/2010 | Zemer | |
| 2012/0136664 | A1 | 5/2012 | Beutnagel et al. | |
| 2013/0102295 | A1 | 4/2013 | Burke et al. | |
| 2013/0151250 | A1 | 6/2013 | VanBlon | |

OTHER PUBLICATIONS

Karabetsos et al., "Embedded Unit Selection Text-to-Speech Synthesis for Mobile Devices," *IEEE Trans. on Consumer Electronics*, vol. 55, No. 2, 2009, pp. 613-621.

"Speech Recognition and Text-to-Speech (WP2)," website—printed Oct. 17, 2013 http://www.gethomesafe-fp7.eu/index.php/work-packages/91-wp2.

* cited by examiner

SYSTEM AND METHOD FOR DISTRIBUTED VOICE MODELS ACROSS CLOUD AND DEVICE FOR EMBEDDED TEXT-TO-SPEECH

PRIORITY INFORMATION

The present application is a continuation of U.S. patent application Ser. No. 14/953,771, filed Nov. 30, 2015, which is a continuation of U.S. patent application Ser. No. 14/025,344, filed Sep. 12, 2013, now U.S. Pat. No. 9,218,804, issued Dec. 22, 2015, the contents of which are incorporated herein by reference in their entireties.

BACKGROUND

1. Field of the Disclosure

The present disclosure relates to speech synthesis and more specifically to caching and intelligently fetching parts of voice models for use in speech synthesis.

2. Introduction

Text-to-speech (TTS) synthesis is a valuable technology for hands-free or eyes-free natural interactions with applications running on mobile devices and other small form factor devices, such as smart phones, tablets, in-car infotainment systems, digital home components, and so forth. A TTS engine can run "embedded" on a device, or in the "cloud," depending on network availability and device capabilities. Both on-device and network-based speech synthesis have advantages and disadvantages. Network-based speech synthesis, in particular, can provide access to large amounts of storage to support very large voice models with good coverage of realistic prosody and phonemic contexts, and to store many different such voice models, supporting varying "personalities" for applications and many different languages. On-device TTS engines, on the other hand, offer reliably low latency responses independent of network conditions or latency, can operate when a network connection is not available, and avoid the costs and overhead associated with deploying and maintaining cloud-based servers.

Existing solutions attempt to reduce the downsides of these approaches by switching between a local a network-based TTS engines on demand. However, these approaches also have downsides of sharp differences between the TTS engines, and still rely on network latency.

BRIEF DESCRIPTION OF THE DRAWINGS

In order to describe the manner in which the above-recited and other advantages and features of the principles disclosed herein can be obtained, a more particular description of the principles briefly described above will be rendered by reference to specific embodiments thereof, which are illustrated in the appended drawings. Understanding that these drawings depict only example embodiments and are not therefore to be considered to be limiting of its scope, these principles will be described and explained with additional specificity and detail through the use of the accompanying drawings in which.

DETAILED DESCRIPTION

Figure 1:
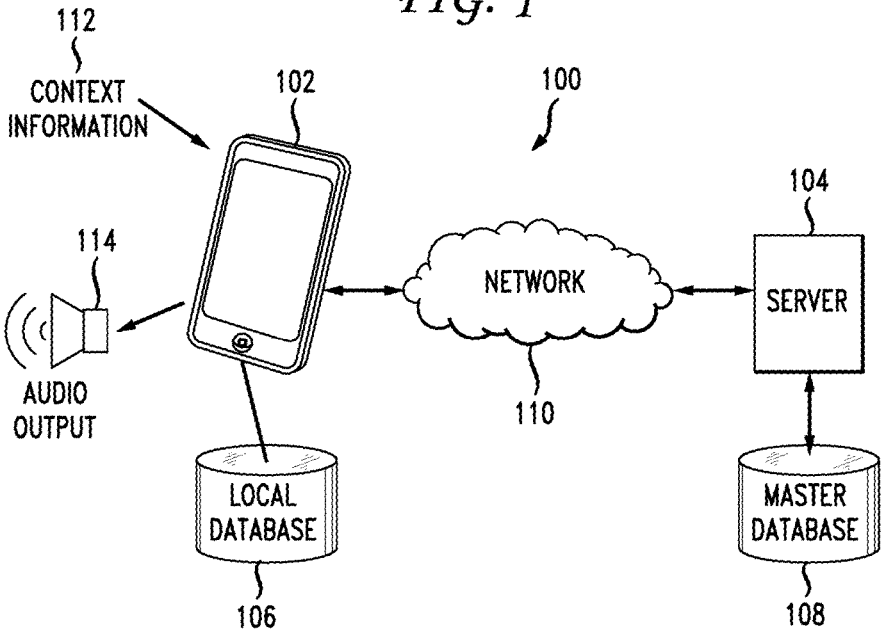
FIG. 1 illustrates an example client and server architecture for synthesizing speech using intelligent caching of voice models.

This disclosure first presents a general discussion of hardware components which may be used in a system or device embodiment. Following the discussion of the hardware and software components, various embodiments shall be discussed with reference to embodiments in which solve the problems of poor quality and limited storage space for TTS voices found in embedded TTS engines by smart pre-fetching and caching of speech units in a hybrid embedded and network solution.

Disclosed herein is a way to provide high quality speech synthesis, comparable to server synthesized speech, by a local embedded TTS engine, such as in a mobile phone or a car, instead of running two totally separate TTS engines, one server-based in the "cloud" and the other locally embedded. When synthesizing speech, the system does not need to decide which engine to use, such as choosing high voice quality TTS from a server or low voice quality TTS from an embedded system. A hybrid/embedded TTS engine delivers significantly improved voice quality by "smart prefetching and caching." Speech units dominate the storage space requirements for TTS voice models. Speech units, otherwise known as text-to-speech units, speech components, synthesis units, phonemes, or speech snippets, are small spans of recorded speech that the runtime TTS engine concatenates or joins in series to produce natural flowing speech. An initially loaded embedded voice model typically includes a most-frequently-used subset of the speech units, a large enough set to pronounce most or all words in the given language, albeit sometimes poorly. The client can download additional speech units as needed, as determined by each text request. Similarly, if speech units have not been used for a long time, the client can delete those speech units. The following two use case scenarios illustrate some of the benefits of smart prefetching and caching.

In a first use case, a user wants to select a song from her iPod™ in the car. The car-based local TTS reads the list of song titles to her. The TTS "knows" the text for the whole list of song titles while (slowly) speaking out the first, then second, then third song title in a longer list of songs. Since the local TTS knows what text it will synthesize eventually, the local TTS can ask a TTS data server "in the cloud" to provide the appropriate speech units, which the local TTS does not already have stored in a cache. These speech units might not be needed immediately, or even in the next two minutes. Network availability plays a lesser role because the local TTS does not need the speech units instantly and can wait up to two minutes or more before the specific speech units for high-quality speech synthesis are needed. Only if the local TTS does not receive the higher-quality speech units in time, the local TTS can use inferior quality speech units stored in a local cache to synthesize the speech.

In a second use case, a user's boss sends him a lengthy, urgent email. So, the user asks the in-car, embedded TTS to read the email to him. Again, because reading the whole email aloud might take 5 or more minutes, or some other amount of time, the local embedded TTS has ample time to obtain some or all of the speech units from the server while beginning to synthesize the speech locally using existing speech units in the cache. As an additional benefit, if a user has recently listened to a similar email, the cache is very likely to contain speech units that the local TTS can reuse for synthesizing many of the same words. As long as speech units that make up these words are still in the cache, the system does not download them again from the server and can reuse them to synthesize the new email.

The local embedded TTS engine can fetch additional speech units on demand to deliver server-like quality without requiring an "always-on" network connection. Through look-ahead prefetching and caching of speech units, the local embedded TTS engine can synthesize speech without making any hard choices between network and embedded TTS. The local embedded TTS engine performs as a "hybrid" because the local embedded TTS engine operates locally, but has "smart" access to a network-based speech units database to populate a local cache.

FIG. 1 illustrates an example client 102 and server 104 architecture 100 for synthesizing speech using intelligent caching of voice models. The client device can be a mobile phone, a tablet, a set-top box, an in-car computing device, a GPS, a gaming or entertainment console, a customer service kiosk, and so forth. For the sake of simplicity, the example client 102 is discussed in terms of a mobile phone. The client 102 receives a request, whether from a user, a program, or some other source, to synthesize speech, or determines within a threshold likelihood that speech will be synthesized at some point in the near future. The client 102 examines context information 112, which can be part of the request to synthesize speech or other situational or predictive information, to predict details of what speech will be synthesized. Based on that prediction, the client 102 can analyze the contents of a local database 106 of speech units to determine which speech units would be helpful, useful, or necessary, and which are absent in the local database 106. While the term database is used for the local database 106 and the master database 108, any suitable data store can be used instead. The local database 106 and the master database 108 generically represent data storage, and are not restricted to any specific products or technologies associated with the term "database," such as a database having field, a fixed record structure, and so forth.

When the client 102 makes a request to the server 104 for a missing "optimal" speech unit, the client 102 can also identify a locally-stored, suboptimal speech unit. If the new speech unit arrives before the speech containing that new speech unit has been synthesized, the client 102 can resynthesize that portion of the output speech. If not, the client 102 synthesizes the speech using a suboptimal speech unit stored in the cache, and when the new speech unit arrives, the client 102 can cache it locally for future use.

The client 102 can use look-ahead techniques to break up text input, and thereby fetch speech units well in advance of when they are needed. By breaking up the text, the client 102 has more time to fetch all pieces after the first. When the speech synthesizer receives long segments of text, the client 102 can break them down into phrases. The client 102 can sequence the audio synthesis for each phrase in one of two ways. The client can synthesize all of the phrases at the start, and if optimal speech units arrive before the audio for a particular phrase is played, then the phrase can be resynthesized. Alternatively, the client 102 can synthesize each phrase just in time to play it, and if requested optimal speech units arrive before this, the synthesizer will include them. If a speech unit has not arrived "in time", the client 102 can delay the next phrase to provide more time for the requested speech unit to arrive. For example, the client 102 can insert an "um" or a pause between two phrases, or slow down a currently uttered phrase.

Prior to synthesizing the speech or simultaneously while starting to synthesize the speech, the client 102 can request these additional speech units, via a network 110, from a server 104 having a master database 108 of speech units. Alternatively, the client 102 can request additional speech units from nearby peers or other devices having appropriate network latency characteristics, for example. The master database 108 may contain all speech units for a particular voice, but may contain fewer speech units. In one example, the client 102 requests missing speech units from the server 104, and if the server 104 does not have the requested missing speech units in the master database 108, the server 104 in turn requests, on behalf of the client 102, the missing speech units from yet another server, not shown. In another example, the device 102 can request speech units that are needed quickly from one source with extremely low latency, and speech units that are needed less quickly (such as in 2 or more minutes) from a different source.

In one variation, the client 102 requests individual speech units from the server 104, and each request is labeled with an indication of its time sensitivity. In this way, the server 104 can determine in what order to service the requests from the client 102 and from other clients, or whether the server 104 should hand off the request to another server for processing, for example.

Figure 2:
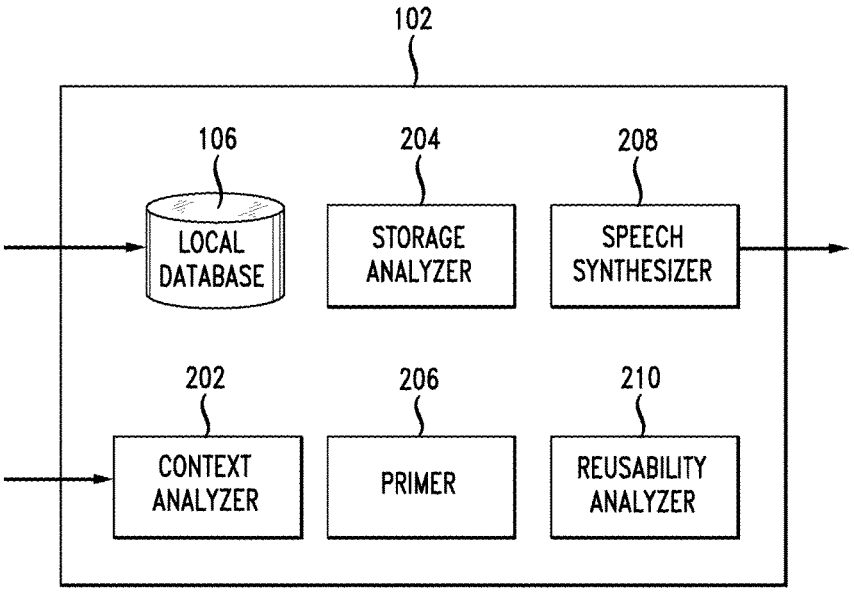
FIG. 2 illustrates a block diagram of an example client device.

As the device 102 receives the speech units from the server 104, the device 102 incorporates the speech units into the local database 106 for immediate use in speech synthesis. FIG. 2 illustrates a block diagram of an example client device 102. The example client device 102 can include additional components other than those depicted, and can also include fewer than all the components depicted. As soon as the speech units are incorporated in the local database 106, the speech synthesizer 208 can select those speech units for use in concatenative speech synthesis.

The client 102 can determine what speech units are needed for generating a specific portion of speech, look to the local database 106 and request what is missing from the server 104. However, the client 102 can alternately report surrounding information to the server 104, which tracks what is stored in the local database 106 and can then determine which speech units are required and transmit them to the client 102. The intelligence for determining which speech units are missing can exist on the client 102 or on the server 104 or both.

Because embedded TTS engines use voice models which, for high quality, can be very large—on the order of one to many gigabytes each—and because storage is a scarce commodity on many mobile device, the local database 106 (or cache) can be managed to conserve existing storage space and use the storage space efficiently. For example, a pruner 206 in the client 102 can examine the speech units stored in the cache to determine which speech units to remove. For example, the pruner 206 can remove speech units from the local database 106 based on one or more factor, such as how long speech units have been stored in the local database 106, how long speech units have gone unused, a likelihood of reuse as indicated by a reusability analyzer 210, a priority ranking, and so forth. Because the large voice models are "spread" across the client 102 and the server 104, the pruner 206 can be aggressive. The client 102 can retrieve pruned speech units from the server 104 as needed. A storage analyzer 204 can determine how much space is available on the device, how much space the local database 106 occupies on the local storage, and so forth. The storage analyzer 204 can, for example, detect a request for additional storage space from another application, and cause the pruner 206 to prune the least needed speech units to free up an indicated amount of storage space. The storage analyzer 204 can likewise temporarily reserve a larger than usual amount of storage to perform a particular speech synthesis job, and prune the local database 106 back to a regular level after synthesizing the speech.

The local cache and intelligent fetching of speech units can be a considered in terms of a "virtual storage hierarchy." The local cache, which can expand up to all the memory the client can afford to devote to speech synthesis, holds what is being used, while "page faults" (i.e. non-local speech units) get transferred in the background. If non-local speech units do not arrive on time, the client can use sub-optimal, but readily available, local speech units instead. Cache management techniques similar to those used in modern CPUs could guarantee an optimal usage of the available storage space.

A context analyzer 202 can receive context information 112 and determine what type of speech needs to be synthesized, when the speech is likely to be needed, and so forth. The context analyzer 202 can examine direct requests to synthesize speech, a user location, user activity, recently synthesized speech, content, sender, and recipients of a message, a user habit, a calendar event, user interactions with an application, and so forth.

In this way, the client 102 can synthesize high quality speech, such as with a very large voice model, albeit at the expense of more network downstream, i.e. server-to-device, traffic. The server stores the full voice model, while the client 102 stores only a subset of the voice model locally, and intelligently caches, fetches, and prunes speech units as needed. This approach can apply to Unit Selection TTS and to Hybrid HMM/Unit Selection TTS.

The client 102 or the server 104 can determine the goodness of fit for a speech unit based on target and concatenation costs. The system can apply a threshold to this this numerical measure, which can be adaptive depending on contextual factors, in particular on available bandwidth, latency, or data plan usage. The system can pre-fetch new speech units based on application content. For example, when new names are added to an address book on the client 102, the client 102 can scan for speech units that are not part of the local database 106. For a stock or finance application, the client 102 can identify speech units for business names. For each new application installed on the client 102, the client can similarly scan for new text or phrases for speech synthesis and request missing speech units. The client 102 can use analytics data to determine which applications are most frequently used, and intelligently populate the cache or local database 106 based on vocabulary used by those most frequently used applications.

Various embodiments of this disclosure are discussed in detail below. While specific implementations are discussed, it should be understood that this is done for illustration purposes only. A person skilled in the relevant art will recognize that other components and configurations may be used without parting from the spirit and scope of the disclosure.

Figure 3:
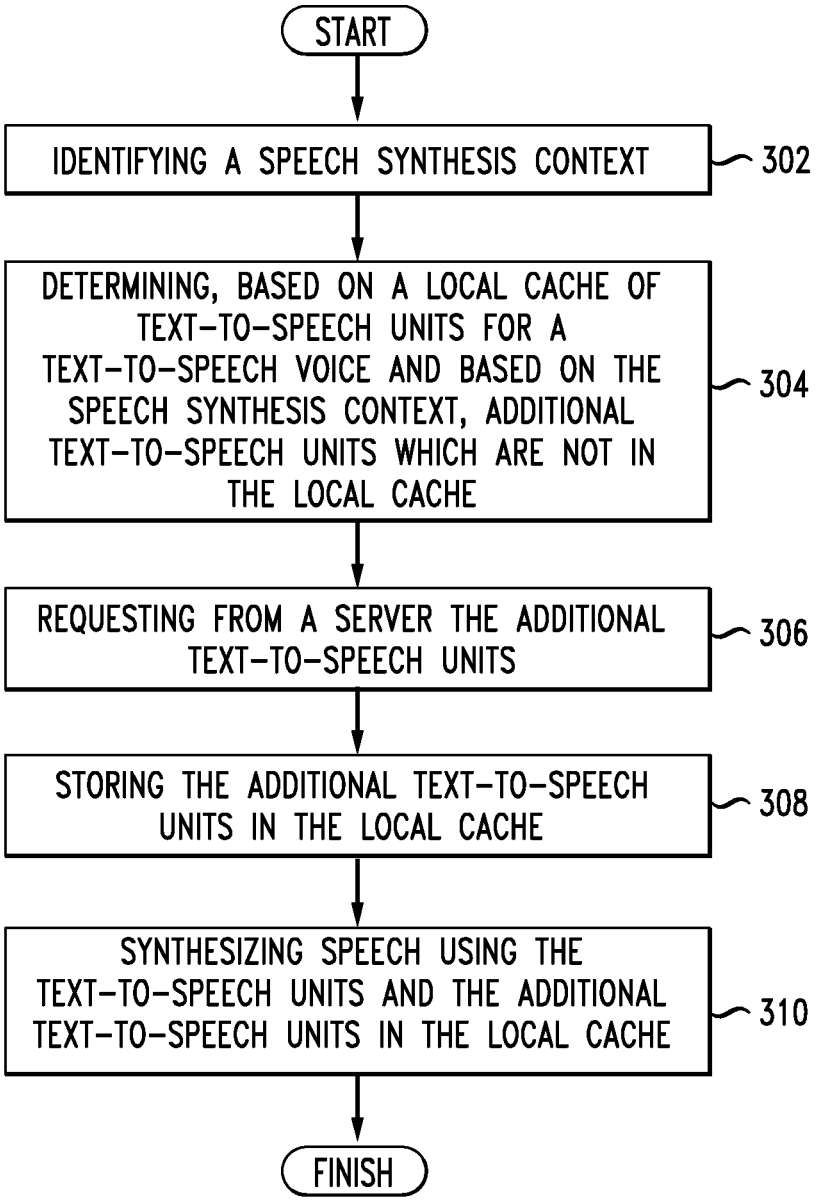
FIG. 3 illustrates an example method embodiment.
Figure 4:
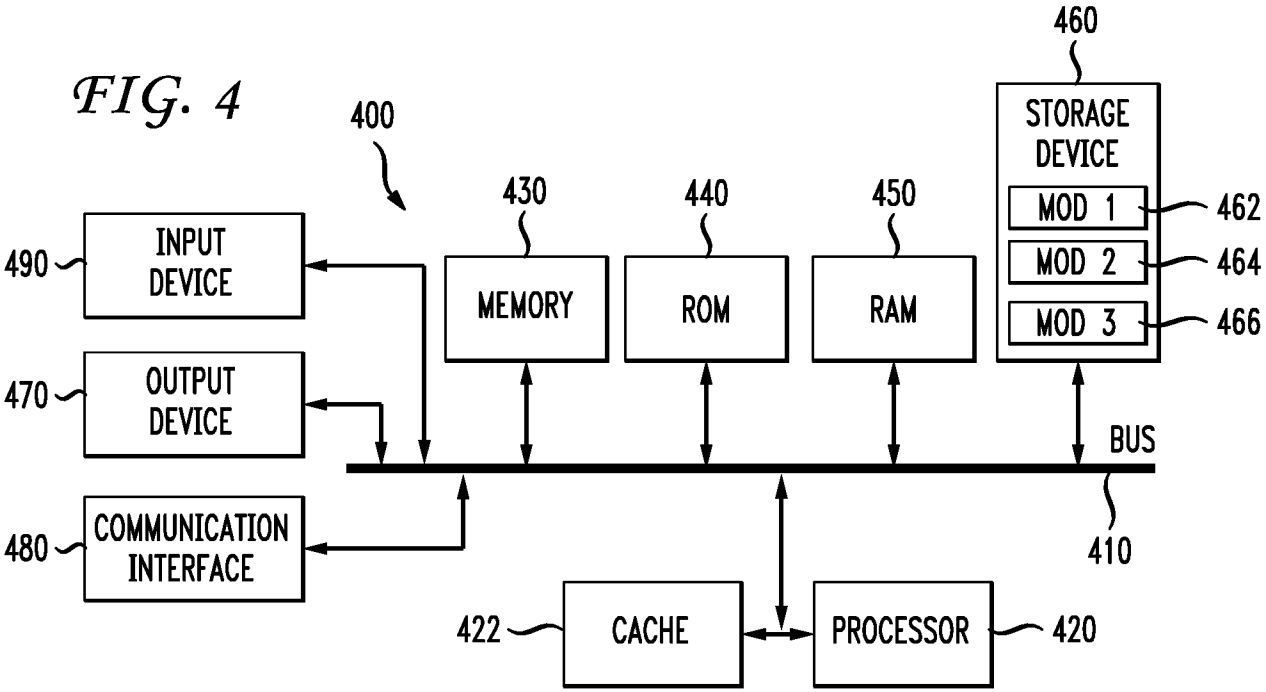
FIG. 4 illustrates an example system embodiment.

Having disclosed some basic system components and concepts, the disclosure now turns to the exemplary method embodiment shown in FIG. 3. For the sake of clarity, the method is discussed in terms of an exemplary system 400, as shown in FIG. 4, configured to practice the method. The steps outlined herein are exemplary and can be implemented in any combination, permutation, or order thereof, including combinations or permutations that exclude, add, or modify certain steps.

A system configured to practice the method for intelligent caching of concatenative speech units for use in speech synthesis can first identify a speech synthesis context (302). The context can include information indicating that a request to synthesize speech has been received. The system can determine, based on a local cache of text-to-speech units for a text-to-speech voice and based on the speech synthesis context, additional text-to-speech units which are not in the local cache (304). The system can predict, for the additional text-to-speech units, percentages of certainty that a particular speech unit is likely to be used, and can prioritize the requests for speech units based on one or more of time sensitivity, likelihood that the speech unit will be needed, reusability of the speech unit, and so forth. For example, the client can request a rarely-used speech unit that has a 40% chance of use in the next 90 seconds with a significantly lower priority than a commonly-used speech unit that has a 80% chance of use in the next 20 seconds.

The system can request from a server the additional text-to-speech units (306), and store the additional text-to-speech units in the local cache (308). The system can determine parameters relating to speech synthesis, and determine, based on the parameters, how many additional text-to-speech units to request. The system can then synthesize speech using the text-to-speech units and the additional text-to-speech units in the local cache (310). The system can begin to synthesize speech using only the local cache of text-to-speech units before receiving the additional text-to-speech units. Then, as additional text-to-speech units are received and stored in the local cache, the system can continue to synthesize speech using the local cache of text-to-speech units and the additional text-to-speech units. In this way, the system can start to synthesize speech immediately using the existing components in the cache, but can efficiently retrieve and start using additional components from a remote location, such as a server, a peer client device, or other remote repository. There is no need to switch between a local text-to-speech engine and a remote text-to-speech engine. The local device can look ahead and 'guess' based on context what text-to-speech units will be needed, fetch predicted speech units that are not available locally, and proceed to synthesize speech using cached components and incorporated fetched components as they are received. The local device can use a lookup table or other index of available speech units to determine which speech units are available from which to select. Alternatively, the local device can provide specifications or parameters to the server as part of a request, and the server can select and return to the local device the closest matching speech units.

The system can optionally prune the cache as the context changes, based on availability of local storage or other variables, after synthesizing the speech, periodically, or based on some period of non-use of a particular speech unit. The local cache can store a core set of text-to-speech units associated with the text-to-speech voice that cannot be pruned from the local cache, except when being replaced with updated or more detailed components or when the text-to-speech voice is deleted, for example. In this way, the system can conserve local storage in the local database 106 while providing high quality synthesis. Intelligent fetching and caching speech units for speech synthesis can greatly increase the practicality and efficiency of embedding TTS technology on mobile devices, while reducing storage requirements on devices that have limited storage space, and while approaching the quality of server-based TTS.

A brief description of a basic general purpose system or computing device in FIG. 4, which can be employed to practice the concepts, is disclosed herein. With reference to FIG. 4, an exemplary system 400 includes a general-purpose computing device 400, including a processing unit (CPU or processor) 420 and a system bus 410 that couples various system components including the system memory 430 such as read only memory (ROM) 440 and random access memory (RAM) 450 to the processor 420. The system 400 can include a cache 422 of high speed memory connected directly with, in close proximity to, or integrated as part of the processor 420. The system 400 copies data from the memory 430 and/or the storage device 460 to the cache 422 for quick access by the processor 420. In this way, the cache provides a performance boost that avoids processor 420 delays while waiting for data. These and other modules can control or be configured to control the processor 420 to perform various actions. Other system memory 430 may be available for use as well. The memory 430 can include multiple different types of memory with different performance characteristics. It can be appreciated that the disclosure may operate on a computing device 400 with more than one processor 420 or on a group or cluster of computing devices networked together to provide greater processing capability. The processor 420 can include any general purpose processor and a hardware module or software module, such as module 1 462, module 2 464, and module 3 466 stored in storage device 460, configured to control the processor 420 as well as a special-purpose processor where software instructions are incorporated into the actual processor design. The processor 420 may essentially be a completely self-contained computing system, containing multiple cores or processors, a bus, memory controller, cache, etc. A multi-core processor may be symmetric or asymmetric.

The system bus 410 may be any of several types of bus structures including a memory bus or memory controller, a peripheral bus, and a local bus using any of a variety of bus architectures. A basic input/output (BIOS) stored in ROM 440 or the like, may provide the basic routine that helps to transfer information between elements within the computing device 400, such as during start-up. The computing device 400 further includes storage devices 460 such as a hard disk drive, a magnetic disk drive, an optical disk drive, tape drive or the like. The storage device 460 can include software modules 462, 464, 466 for controlling the processor 420. Other hardware or software modules are contemplated. The storage device 460 is connected to the system bus 410 by a drive interface. The drives and the associated computer readable storage media provide nonvolatile storage of computer readable instructions, data structures, program modules and other data for the computing device 400. In one aspect, a hardware module that performs a particular function includes the software component stored in a non-transitory computer-readable medium in connection with the necessary hardware components, such as the processor 420, bus 410, display 470, and so forth, to carry out the function. The basic components are known to those of skill in the art and appropriate variations are contemplated depending on the type of device, such as whether the device 400 is a small, handheld computing device, a desktop computer, or a computer server.

Although the exemplary embodiment described herein employs the hard disk 460, it should be appreciated by those skilled in the art that other types of computer readable media which can store data that are accessible by a computer, such as magnetic cassettes, flash memory cards, digital versatile disks, cartridges, random access memories (RAMs) 450, read only memory (ROM) 440, a cable or wireless signal containing a bit stream and the like, may also be used in the exemplary operating environment. Non-transitory computer-readable storage media expressly exclude media such as energy, carrier signals, electromagnetic waves, and signals per se.

To enable user interaction with the computing device 400, an input device 490 represents any number of input mechanisms, such as a microphone for speech, a touch-sensitive screen for gesture or graphical input, keyboard, mouse, motion input, speech and so forth. An output device 470 can also be one or more of a number of output mechanisms known to those of skill in the art. In some instances, multimodal systems enable a user to provide multiple types of input to communicate with the computing device 400. The communications interface 480 generally governs and manages the user input and system output. There is no restriction on operating on any particular hardware arrangement and therefore the basic features here may easily be substituted for improved hardware or firmware arrangements as they are developed.

For clarity of explanation, the illustrative system embodiment is presented as including individual functional blocks including functional blocks labeled as a "processor" or processor 420. The functions these blocks represent may be provided through the use of either shared or dedicated hardware, including, but not limited to, hardware capable of executing software and hardware, such as a processor 420, that is purpose-built to operate as an equivalent to software executing on a general purpose processor. For example the functions of one or more processors presented in FIG. 4 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 440 for storing software performing the operations discussed below, and random access memory (RAM) 450 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 400 shown in FIG. 4 can practice all or part of the recited methods, can be a part of the recited systems, and/or can operate according to instructions in the recited non-transitory computer-readable storage media. Such logical operations can be implemented as modules configured to control the processor 420 to perform particular functions according to the programming of the module. For example, FIG. 4 illustrates three modules Mod1 462, Mod2 464 and Mod3 466 which are modules configured to control the processor 420. These modules may be stored on the storage device 460 and loaded into RAM 450 or memory 430 at runtime or may be stored as would be known in the art in other computer-readable memory locations.

Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the disclosure may be practiced in network computing environments with many types of computer system configurations, including personal computers, hand-held devices, multi-processor systems, microprocessor-based or programmable consumer electronics, network PCs, mini-computers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. For example, the principles herein can apply to mobile phones, automobile-based speech synthesis, tablets, desktop or laptop computers, customer service kiosks, embedded systems with limited storage or memory, set-top boxes, and so forth. Caching speech units can be useful in speech technology, wireless services, or devices such as phones, tablets, in-car and in-home automation systems, wireless providers, and so forth. Virtually any device with a network connection and a need to perform speech synthesis can be adapted to incorporate the principles set forth herein. Those skilled in the art will readily recognize various modifications and changes that may be made to the principles described herein without following the example embodiments and applications illustrated and described herein, and without departing from the spirit and scope of the disclosure.

We claim:

1. A method comprising:

identifying speech units that are required for synthesizing speech from a text using text-to-speech;

determining that an absent speech unit is not in memory and is needed for synthesizing the speech from the text;

receiving the absent speech unit from a server, to yield a received speech unit; and synthesizing the speech from the text using the speech units and the received speech unit.

2. The method of claim 1, further comprising:

storing the received speech unit in a local cache; and pruning the local cache after synthesizing the speech.

3. The method of claim 2, wherein the local cache stores a core set of text-to-speech units associated with a text-to-speech voice that cannot be pruned from the local cache.

4. The method of claim 2, wherein the local cache comprises speech snippets for use in concatenative synthesis.

5. The method of claim 1, further comprising:

determining parameters relating to speech synthesis; and determining, based on the parameters, how many additional speech units to request.

6. The method of claim 1, further comprising receiving a request to synthesize the speech.

7. The method of claim 1, further comprising:

beginning to synthesize the speech using only a first portion of the speech units before receiving the received speech unit; and continuing to synthesize the speech using the first portion of the speech units and the received speech unit.

8. A system comprising:

a processor; and a computer-readable storage medium having instructions stored which, when executed by the processor, cause the processor to perform operations comprising:

identifying speech units that are required for synthesizing speech from a text using text-to-speech;

determining that an absent speech unit is not in memory and is needed for synthesizing the speech from the text;

receiving the absent speech unit from a server, to yield a received speech unit; and synthesizing the speech from the text using the speech units and the received speech unit.

9. The system of claim 8, the computer-readable storage medium having additional instructions stored which, when executed by the processor, cause the processor to perform operations comprising:

storing the received speech unit in a local cache; and pruning the local cache after synthesizing the speech.

10. The system of claim 9, wherein the local cache stores a core set of speech units associated with a text-to-speech voice that cannot be pruned from the local cache.

11. The system of claim 9, wherein the local cache comprises speech snippets for use in concatenative synthesis.

12. The system of claim 8, the computer-readable storage medium having additional instructions stored which, when executed by the processor, cause the processor to perform operations comprising:

determining parameters relating to speech synthesis; and determining, based on the parameters, how many additional speech units to request.

13. The system of claim 8, the computer-readable storage medium having additional instructions stored which, when executed by the processor, cause the processor to perform operations comprising receiving a request to synthesize the speech.

14. The system of claim 8, the computer-readable storage medium having additional instructions stored which, when executed by the processor, cause the processor to perform operations comprising:

beginning to synthesize the speech using only a first portion of the speech units before receiving the received speech unit; and continuing to synthesize the speech using the first portion of the speech units and the received speech unit.

15. A computer-readable storage device having instructions stored which, when executed by a computing device, cause the computing device to perform operations comprising:

identifying speech units that are required for synthesizing speech from a text using text-to-speech;

determining that an absent speech unit is not in memory and is needed for synthesizing the speech from the text;

receiving the absent speech unit from a server, to yield a received speech unit; and synthesizing the speech from the text using the speech units and the received speech unit.

16. The computer-readable storage device of claim 15 having additional instructions stored which, when executed by the computing device, cause the computing device to perform operations comprising:

storing the received speech unit in a local cache; and pruning the local cache after synthesizing the speech.

17. The computer-readable storage device of claim 16, wherein the local cache stores a core set of speech units associated with a text-to-speech voice that cannot be pruned from the local cache.

18. The computer-readable storage device of claim 15, having additional instructions stored which, when executed by the computing device, cause the computing device to perform operations comprising receiving a request to synthesize the speech.

19. The computer-readable storage device of claim 15, having additional instructions stored which, when executed by the computing device, cause the computing device to perform operations comprising:

determining parameters relating to speech synthesis; and determining, based on the parameters, how many additional speech units to request.

20. The computer-readable storage device of claim 15, wherein a local cache comprises speech snippets for use in concatenative synthesis.

* * * * *